US006322906B1

(12) United States Patent
Nakakoji et al.

(10) Patent No.: US 6,322,906 B1
(45) Date of Patent: Nov. 27, 2001

(54) PERFORATIVE CORROSION RESISTANT GALVANIZED STEEL SHEET

(75) Inventors: Hisatada Nakakoji; Kyoko Hamahara; Kazuo Mochizuki; Kazumi Yamashita, all of Chiba (JP)

(73) Assignee: Kawasaki Steel Corporation, Tokyo (JP)

( * ) Notice: Subject to any disclaimer, the term of this patent is extended or adjusted under 35 U.S.C. 154(b) by 0 days.

(21) Appl. No.: 09/611,723

(22) Filed: Jul. 6, 2000

(30) Foreign Application Priority Data

Jul. 8, 1999 (JP) ..... 11-194645

(51) Int. Cl.[7] ..... B32B 15/00

(52) U.S. Cl. ..... 428/659; 148/261; 148/262; 428/628; 428/658; 428/472.3

(58) Field of Search ..... 428/659, 658, 428/472.3, 628; 148/261, 262

(56) References Cited

U.S. PATENT DOCUMENTS

| | | | |
|---|---|---|---|
| 5,207,840 | 5/1993 | Riesop et al. | 148/262 |
| 5,401,381 | 3/1995 | Seidel et al. | 205/177 |

FOREIGN PATENT DOCUMENTS

| | | | |
|---|---|---|---|
| 4241134A1 | 6/1994 | (DE) . | |
| 19740953A1 | 3/1999 | (DE) . | |
| 0653502A2 | 5/1995 | (EP) . | |
| 0653502-A2 * | 5/1995 | (EP) | C23C/22/73 |
| 1263280 | 10/1999 | (JP) . | |

* cited by examiner

*Primary Examiner*—Robert R. Koehler
(74) *Attorney, Agent, or Firm*—Young & Thompson

(57) ABSTRACT

A galvanized steel sheet includes a galvanized coating layer having a coating weight of from about 20 to about 60 g/m$^2$ formed on at least one surface of the steel sheet, and a zinc phosphate coating layer having a coating weight of from about 0.5 to about 3.0 g/m$^2$ formed on the galvanized coating layer. The zinc phosphate coating layer contains from about 0.5 to about 10.0 percent by weight of magnesium, from about 0.1 to about 2.0 percent by weight of nickel, and from about 0.5 to about 8.0 percent by weight of manganese. However, the manganese content and the nickel content satisfy the following relationship: $[Ni]\times 7.6-10.9 \leqq [Mn] \leqq [Ni]\times 11.4$ wherein [Mn] represents the manganese content, in percent by weight, and [Ni] represents the nickel content, in percent by weight. This steel sheet exhibits superior perforative corrosion resistance. The steel sheet also exhibits superior press workability by further controlling the magnesium, nickel, and manganese contents.

3 Claims, 5 Drawing Sheets

10 μm

Mg CONTENT : 0 PERCENT BY MASS
Ni CONTENT : 1.3 PERCENT BY MASS
Mn CONTENT : 1.9 PERCENT BY MASS

10 μm

Mg CONTENT : 1.1 PERCENT BY MASS
Ni CONTENT : 1.3 PERCENT BY MASS
Mn CONTENT : 1.6 PERCENT BY MASS

10 μm

Mg CONTENT : 2.1 PERCENT BY MASS
Ni CONTENT : 0.7 PERCENT BY MASS
Mn CONTENT : 1.3 PERCENT BY MASS

10 μm

Mg CONTENT : 4.0 PERCENT BY MASS
Ni CONTENT : 0.3 PERCENT BY MASS
Mn CONTENT : 1.0 PERCENT BY MASS

PERFORATIVE CORROSION RESISTANT GALVANIZED STEEL SHEET

BACKGROUND OF THE INVENTION

1. Field of the Invention

The present invention relates to galvanized steel sheets which are used in automobile bodies and which have significantly improved perforative corrosion resistance after electrocoating, without adverse effects on other properties.

2. Description of the Related Art

Galvanized steel sheets have been widely used in order to prevent decreased strength of automobile bodies over the long term in corrosive environments. For example, in Japan, zinc-nickel alloy coated steel sheets and zinc-iron alloy coated steel sheets have been typically used. Although the zinc-nickel alloy and the zinc-iron alloy ensure high corrosion resistance of the steel sheets, these alloys have some problems.

The zinc-nickel alloy coated steel sheet is produced by an electroplating process and results in high material costs due to the use of nickel which is expensive. Moreover, the nickel content must be restricted to a narrow range, such as 12±1 percent by weight, making the production of the zinc-nickel alloy steel sheet difficult.

The zinc-iron alloy coated steel sheet may be produced by either an electroplating process or a hot dipping process. When the zinc-iron alloy coated steel sheet is produced by an electroplating process, the iron content in the zinc coating layer also must be controlled within an extremely narrow range. Since ferrous ($Fe^{2+}$) ions in the plating solution are readily oxidized, the zinc-iron alloy coated steel sheet cannot be stably produced, resulting in increased production costs.

In most cases, the zinc-iron alloy coated steel sheet is produced by a hot dipping process. In this process, molten zinc is coated on surfaces of a steel sheet, and the steel sheet is maintained at a high temperature to promote alloying of the steel and zinc. In this process, however, the quality of the steel sheet significantly depends on the aluminum concentration in the molten zinc plating bath, and the temperature and the time of the alloying step. Thus, advanced technology is required for the production of a uniform coating layer, resulting in increased production costs.

As described above, all the zinc-based alloy coating processes are difficult and incur increased costs.

On the other hand, galvanized steel sheets including only zinc layers can be produced by either electroplating or hot dipping at low cost. However, galvanized steel sheets have not been significantly used in automobile bodies due to the inadequate corrosion resistance thereof. When the galvanized steel sheet is exposed to a corrosive environment for long periods, the steel sheet is readily perforated due to corrosion, and the strength of the body is adversely affected.

In the production of an automobile body, a steel sheet or a coated steel sheet is subjected to press working, a chemical conversion treatment, electrocoating, and spray coating. Perforations due to corrosion typically form at the bottom portions of doors, because the bottom portions are bent and water which enters from gaps at the window collects at the bottoms of the doors, promoting corrosion of the steel sheet.

Among the above treatments, the chemical conversion treatment and the electrocoating treat the bent bottom portion of the door. However, the subsequent spray coating does not reach the narrow bent bottom portion. Since an improvement in corrosion resistance due to the spray coating is not achieved, perforative corrosion resistance after the electrocoating is significantly important.

In order to improve corrosion resistance of the galvanized steel sheet under such circumstances, methods for forming a phosphate film containing magnesium on a zinc-based coating layer by a chemical conversion treatment (phosphate treatment) have been disclosed.

For example, Japanese Unexamined Patent Application Publication No. 1-312081 discloses a surface treated metallic material having a phosphate coating film containing 0.1 percent by weight or more of magnesium formed on an electrogalvanizing layer. This metallic material having a magnesium-containing phosphate coating film has reduced rust formation in salt spray tests, but exhibits inadequate perforative corrosion resistance in a combined cycling corrosion test in which the corrosion is very similar to the actual corrosion of an automobile body.

Japanese Unexamined Patent Application Publication No. 3-107469 discloses a material having a phosphate coating film containing 1 to 7 percent of magnesium formed on an electrogalvanized layer. This material also has reduced rust formation in salt spray tests, but exhibits inadequate perforative corrosion resistance in the combined cycling corrosion test.

Japanese Unexamined Patent Application Publication No. 7-138764 discloses a zinc-containing metal coated steel sheet in which a zinc phosphate composite film containing zinc and phosphorus in a weight ratio (zinc/phosphorus) of 2.504:1 to 3.166:1, and 0.06 to 9.0 percent by weight of at least one metal selected from iron, cobalt, nickel, calcium, magnesium, and manganese is formed on a zinc-containing metal coating layer. This coated steel sheet exhibits superior high-speed press workability in automobile production, but has poor corrosion resistance and inadequate perforative corrosion resistance.

In summary, the zinc-based alloy plating incurs increased cost, while the use of the inexpensive zinc plating in automobile bodies results in inadequate corrosion resistance. Various methods have been attempted in order to improve corrosion resistance of the zinc plating. Among these, the formation of a phosphate coating film containing a specific amount of magnesium does not adequately improve perforative corrosion resistance.

SUMMARY OF THE INVENTION

It is an object of the present invention to provide a galvanized steel sheet which is used in automobile bodies and which has significantly improved perforative corrosion resistance after electrocoating, without adverse effects on other properties.

The present inventors have completed the present invention based on the following conclusion after extensive study. When predetermined amounts of a galvanized coating layer and a zinc phosphate coating layer are formed, in that order, on a steel sheet, and when the magnesium, nickel, and manganese contents in the zinc phosphate coating layer are uniquely controlled, perforative corrosion resistance after electrocoating can be significantly improved without adverse effects on other properties.

According to the present invention, a perforative corrosion resistant galvanized steel sheet comprises a galvanized coating layer having a coating weight of 20 to 60 $g/m^2$ formed on at least one surface of the steel sheet, and a zinc phosphate coating layer having a coating weight of 0.5 to 3.0 $g/m^2$ formed on the galvanized coating layer, the zinc phosphate coating layer containing from about 0.5 to about 10.0 percent by weight of magnesium, from about 0.1 to about 2.0 percent by weight of nickel, and from about 0.5 to about 8.0 percent by weight of manganese, the manganese content and the nickel content satisfying the following relationship:

$$[Ni]\times 7.6-10.9 \leqq [Mn] \leqq [Ni]\times 11.4$$

where [Mn] represents the manganese content, in percent by weight, and [Ni] represents the nickel content, in percent by weight.

Preferably, the zinc phosphate coating layer contains from about 2.0 to about 7.0 percent by weight of magnesium, from about 0.1 to about 1.4 percent by weight of nickel, and from about 0.5 to about 5.0 percent by weight of manganese in order to improve press workability in addition to perforative corrosion resistance.

More preferably, zinc phosphate in the zinc phosphate coating layer comprises granular crystals having a long axis of less than about 2.5 $\mu$m in order to further improve press workability.

DESCRIPTION OF THE PREFERRED EMBODIMENTS

Figure 1:
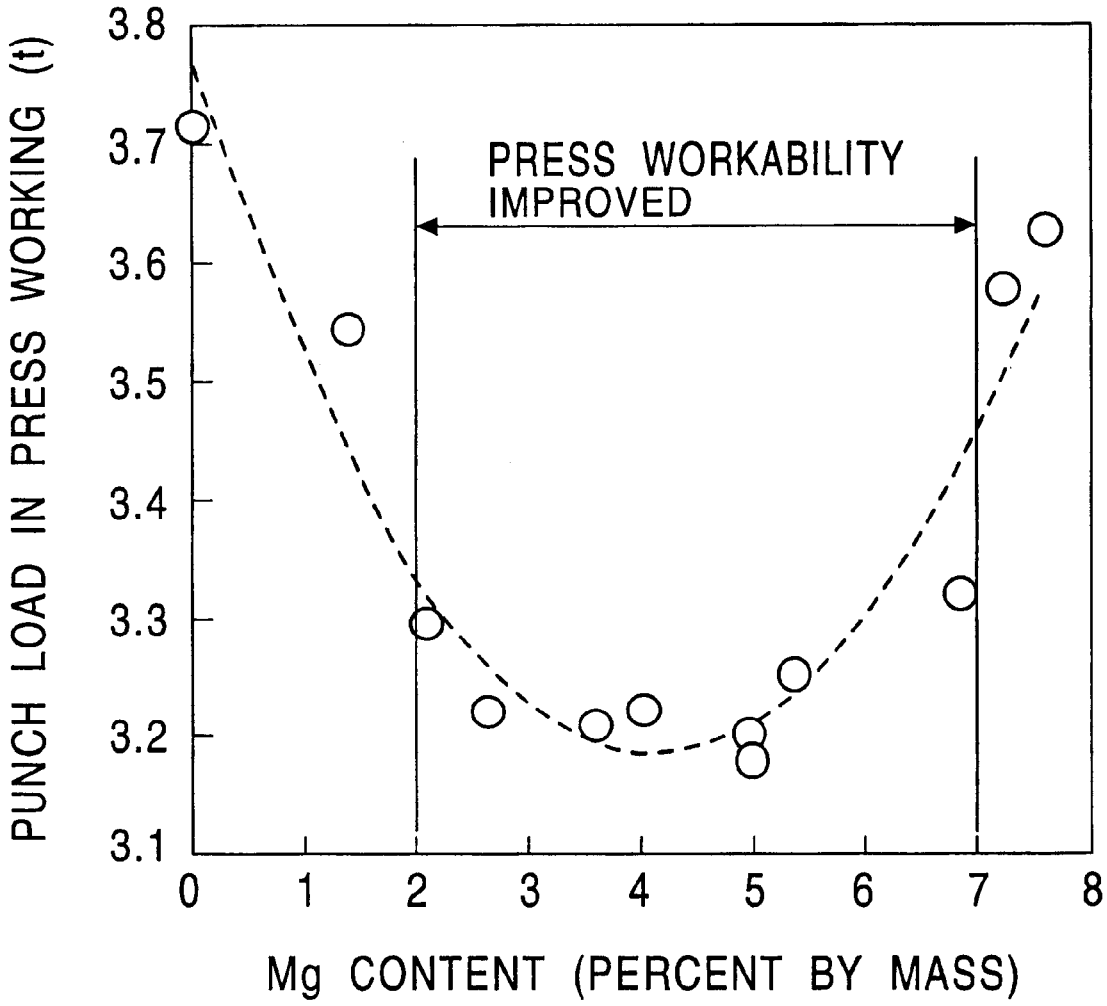
FIG. 1 is a graph illustrating the relationship between the punch load and the magnesium content in a zinc phosphate coating layer in press working tests of various steel sheets having different magnesium contents in the zinc phosphate coating layers.

The reasons for the values of the weight percent ranges in the present invention will now be described.

(1) Galvanized Coating Layer

Coating weight: from about 20 to about 60 g/m$^2$

The coating weight of the galvanized coating layer should be in a range of from about 20 to about 60 g/m$^2$. A coating weight of less than about 20 g/m$^2$ results in inadequate perforative corrosion resistance, while a coating weight exceeding about 60 g/m$^2$ causes deterioration of press workability and weldability, in addition to increased material costs due to the use of a large amount of zinc, in spite of having adequate perforative corrosion resistance.

The galvanized coating layer may be formed by a conventional electroplating or hot dipping process.

In general, the galvanized coating layer formed by the conventional method contains incidental impurities, such as tin, nickel, iron, and aluminum. Also, in the present invention, the galvanized coating layer may contain such incidental impurities. In such a case, the content of each incidental impurity is preferably about 1 percent by weight or less.

(2) Zinc Phosphate Coating Layer (2-1) Coating weight: from about 0.5 to about 3.0 g/m$^2$ The coating weight of the zinc phosphate coating layer is preferably in a range from about 0.5 to about 3.0 g/m$^2$. A coating weight of less than about 0.5 g/m$^2$ results in inadequate perforative corrosion resistance, while a coating weight exceeding about 3.0 g/m$^2$ results in reduction of press workability due to increased surface drag, in addition to increased processing costs due to prolonged processing times, in spite of having adequate perforative corrosion resistance.

(2-2) Composition of Zinc Phosphate Coating Layer

The zinc phosphate coating layer contains from about 0.5 to about 10.0 percent by weight of magnesium, from about 0.1 to about 2.0 percent by weight of nickel, and from about 0.5 to about 8.0 percent by weight of manganese, and the manganese content and the nickel content satisfies the following relationship:

$$[Ni]\times 7.6-10.9 \leqq [Mn] \leqq [Ni]\times 11.4$$

wherein [Mn] represents the manganese content (percent by weight) and [Ni] represents the nickel content (percent by weight). It i s preferable that the zinc phosphate coating layer contain from about 2.0 to about 7.0 percent by weight of magnesium, from about 0.1 to about 1.4 percent by weight of nickel, and from about 0.5 to about 5.0 percent by weight of manganese, and that the above relationship be satisfied, in order to improve press workability in addition to perforative corrosion resistance.

The process by which the above composition was determined will now be described.

In a production process of an automobile body, the body is assembled by welding pressed steel sheets and is subjected to a chemical conversion treatment, electrocoating, and spray coating. Portions that are insufficiently spray coated are readily perforated.

After the spray coating, when a galvanized steel sheet is exposed to a corrosive environment, moisture contained in the corrosive environment condenses into the chemical conversion coating as absorbed water or bound water. As a result, the coating swells and corrosion is accelerated. Thus, galvanized steel sheets for automobiles generally contain nickel and manganese in the chemical conversion coatings (zinc phosphate coating layer) in order to prevent moisture condensation and to improve corrosion resistance after electrocoating.

It is known that a magnesium content in the zinc phosphate coating layer improves corrosion resistance.

The present inventors have intensively studied improvements in perforative corrosion resistance after electrocoating based on the hypothesis that appropriate amounts of magnesium, nickel, and manganese in the zinc phosphate coating layer contribute to improved perforative corrosion resistance by the synergy of the improvement in corrosion resistance by magnesium and suppression of swelling of the coating layer by nickel and manganese.

When the zinc phosphate coating layer, however, contains magnesium in an amount which is greater than a certain amount, the coating layer does not contain appropriate amounts of nickel and manganese. When the zinc phosphate coating layer contains nickel and manganese in amounts which are greater than certain amounts, the coating layer does not contain an appropriate amount of magnesium. Accordingly, the zinc phosphate coating layer does not simultaneously contain appropriate amounts of magnesium, nickel, and manganese, and thus does not exhibit high levels of perforative resistance.

The present inventors have further studied the zinc phosphate coating layers containing appropriate amounts of magnesium, nickel, and manganese, and have discovered that a zinc phosphate coating layer containing from about 0.5 to about 10.0 percent by weight of magnesium exhibits improved corrosion resistance and can contain appropriate amounts of nickel and manganese which are effective for preventing swelling of the coating layer. Moreover, optimized nickel and manganese contents contribute to a significant improvement in perforative corrosion resistance after electrocoating. The present invention was made according to these results.

Figure 3:
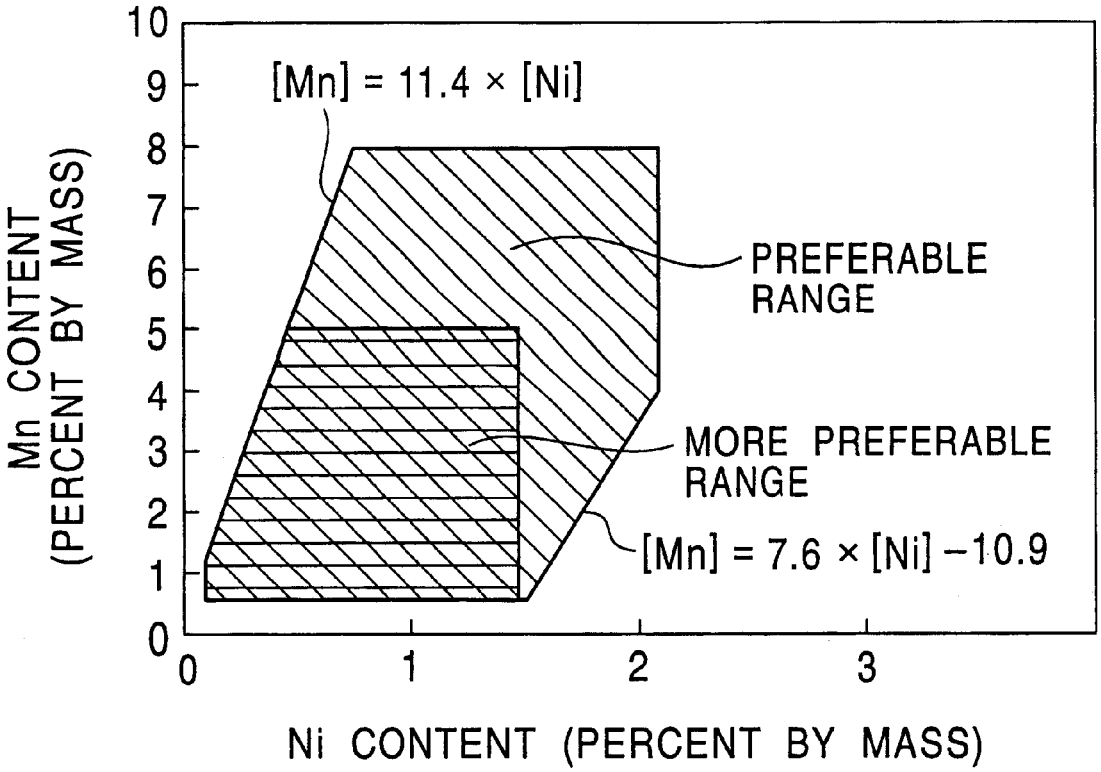
FIG. 3 is a graph illustrating preferred ranges of the manganese and nickel contents in a zinc phosphate coating layer formed on a galvanized steel sheet in accordance with the present invention.

Thus, the zinc phosphate coating layer in the present invention contains from about 0.5 to about 10.0 percent by weight of magnesium, from about 0.1 to about 2.0 percent by weight of nickel, and from about 0.5 to about 8.0 percent by weight of manganese, and the manganese content and the nickel content satisfies the following relationship: $[Ni]\times 7.6-10.9 \leqq [Mn] \leqq [Ni]\times 11.4$. In summary, the magnesium content should be in a range from about 0.5 to about 10.0 percent by weight, and the nickel and magnesium contents should be in a preferred range (hatched range) shown in FIG. 3.

A magnesium content of less than about 0.5 percent by mass results in inadequate perforative corrosion resistance, whereas a magnesium content exceeding about 10.0 percent by weight also results in inadequate perforative corrosion resistance due to swelling of the coating layer in corrosive environments since the zinc phosphate coating layer does not contain appropriate amounts of nickel and manganese.

A nickel content of less than about 0.1 percent by weight or a manganese content of less than about 0.5 percent by weight results in inadequate perforative corrosion resistance due to swelling of the coating layer in corrosive environments. A nickel content exceeding about 2.0 percent by weight or a manganese content exceeding about 8.0 percent by weight also results in inadequate perforative corrosion resistance since the zinc phosphate coating layer does not contain the minimum appropriate magnesium content, that is, about 0.5 percent by weight.

When the manganese content is less than about $\{[Ni]\times 7.6-10.9\}$ wherein [Ni] represents the nickel content (percent by weight), perforative corrosion resistance is inadequate due to swelling of the coating layer induced in corrosive environments. When the manganese content exceeds about $[Ni]\times 11.4$, perforative corrosion resistance is also inadequate since the zinc phosphate coating layer does not contain about 0.5 percent or more by weight of magnesium.

Thus, an important feature of the present invention is that the zinc phosphate coating layer contains from about 0.5 to about 10.0 percent by weight of magnesium, from about 0.1 to about 2.0 percent by weight of nickel, and from about 0.5 to about 8.0 percent by weight of manganese, and the manganese content and the nickel content satisfies the following relationship: $[Ni]\times 7.6-10.9 \leqq [Mn] \leqq [Ni]\times 11.4$. As a result, perforative corrosion resistance is significantly improved without adverse effects on other properties.

As described above, it is preferable that the zinc phosphate coating layer contain from about 2.0 to about 7.0 percent by weight of magnesium, from about 0.1 to about 1.4 percent by weight of nickel, and from about 0.5 to about 5.0 percent by weight of manganese, and that the manganese content and the nickel content satisfy the following relationship: $[Ni]\times 7.6-10.9 \leqq [Mn] \leqq [Ni]\times 11.4$, in order to improve press workability in addition to perforative corrosion resistance. In this case, the nickel and manganese contents are shown in a more preferred range (crosshatched range) in FIG. 3.

When the magnesium content in the zinc phosphate coating layer is in a range of from about 2.0 to about 7.0 percent by weight, zinc phosphate crystals are granular and have long axes (lengths) of less than about 2.5 $\mu$m, and press workability is significantly improved. It is likely that fine granular zinc phosphate crystals moderate sliding friction between the steel sheet and a mold during the press working.

Figure 2A:
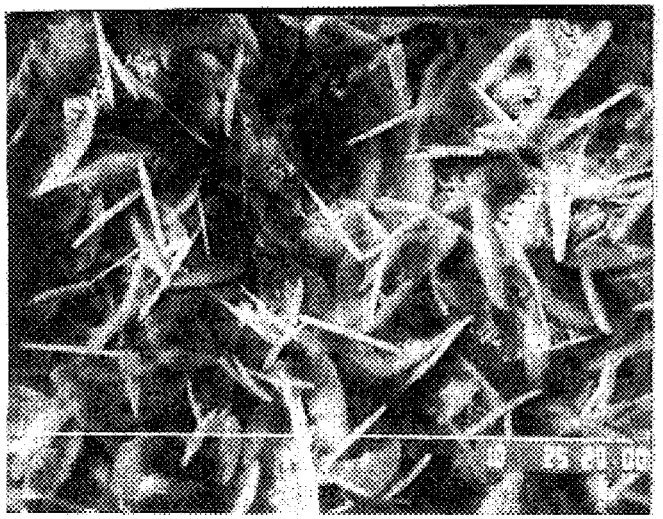
FIGS. 2A to 2D are scanning electron micrographs of surfaces of zinc phosphate coating layers of four galvanized steel sheets having different magnesium, nickel, and manganese contents in the zinc phosphate coating layers.
Figure 2B:
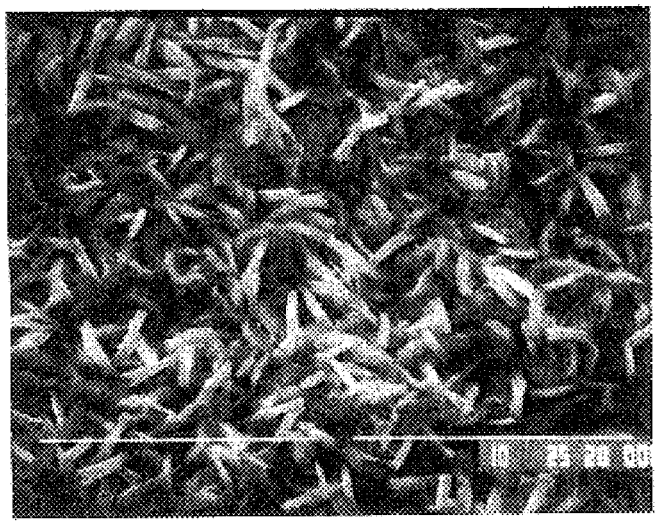

With reference to FIGS. 2A and 2B, the zinc phosphate crystals are foliate and have long axes (lengths) of about 2.5 $\mu$m or more when the magnesium content is less than about 2.0 percent by weight. In such a case, press workability is not so significantly improved. The zinc phosphate crystals are fragile when the magnesium content exceeds about 7.0 percent by weight. In such a case, press workability is not very significantly improved.

FIG. 1 shows the results of press workability of various galvanized steel sheets having different magnesium contents in the zinc phosphate coating layers and having a blank diameter of 100 mm in a press working test under conditions of a punch diameter of 50 mm, a die diameter of 52 mm, a blank holder pressure of 1 ton, and a punch speed of 120 mm/min. In FIG. 1, the ordinate indicates the punch load (t) during the press working, while the abscissa indicates the magnesium content (percent by weight) in the zinc phosphate coating layer. FIG. 1 shows that the press workability is improved when the punch load is low.

Figure 2C:
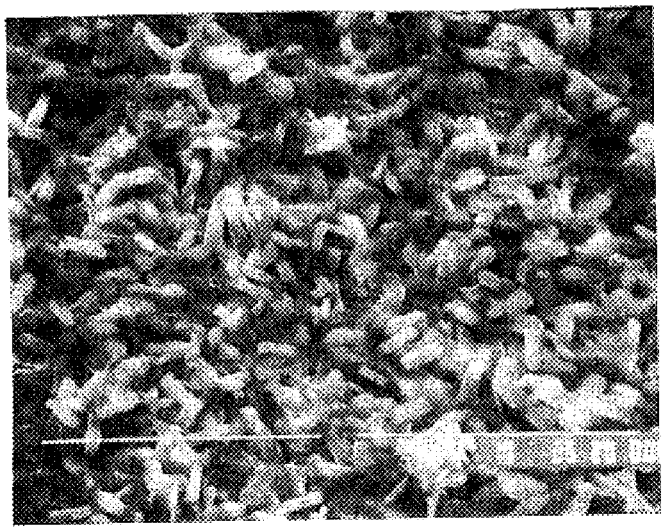
Figure 2D:
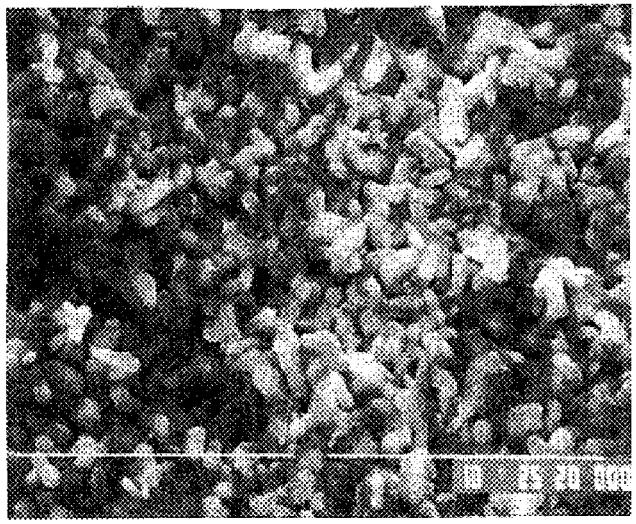
Figure 4:
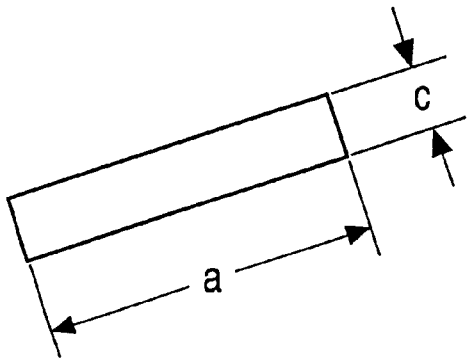
FIG. 4 is a schematic view of a granular zinc phosphate crystal formed on a galvanized steel sheet in accordance with the present invention.

FIGS. 2A to 2D are scanning electron micrographs of surfaces of zinc phosphate coating layers of four galvanized steel sheets having different magnesium, nickel, and manganese contents in the zinc phosphate coating layers. As shown in FIGS. 2C and 2D, the zinc phosphate crystals are fine granular and have long axes (lengths) of less than about 2.5 $\mu$m when the magnesium content is in a range of from about 2.0 to about 7.0 percent by weight which contributes significantly to improved press workability. Herein, "granular" indicates the crystal form shown in FIG. 4 in which the ratio of the short side c to the long axis (length) a is greater than about 0.2.

Accordingly, it is preferable that the magnesium content be in a range of from about 2.0 to about 7.0 percent by weight to further improve press workability. However, a nickel content exceeding about 1.4 percent by weight or a manganese content exceeding about 5.0 percent by weight in the zinc phosphate coating layer inhibits the formation of fine granular zinc phosphate crystals, but promotes the formation of foliate zinc phosphate crystals having long axes (lengths) of about 2.5 $\mu$m or more. In such a case, press workability is not improved.

It is further understood by those skilled in the art that the above description is a preferred embodiment and that various changes and modifications may be made in the present invention without departing from the spirit and scope thereof.

EXAMPLES

Examples of the present invention will now be described.

Four galvanized steel sheets having predetermined amounts of galvanized coating weight were prepared by methods as indicated in Table 1. These steel sheets were dipped into a zinc phosphate conversion solution having a composition shown in Table 2. Table 3 shows the specifications of the resulting zinc phosphate coating layers, that is, the coating weight, the nickel, manganese, and magnesium contents, and the shape and size of the zinc phosphate crystals. Before the zinc phosphate treatment, the steel sheets were subjected to a degreasing treatment and then a conventional surface tempering treatment.

Figure 5:
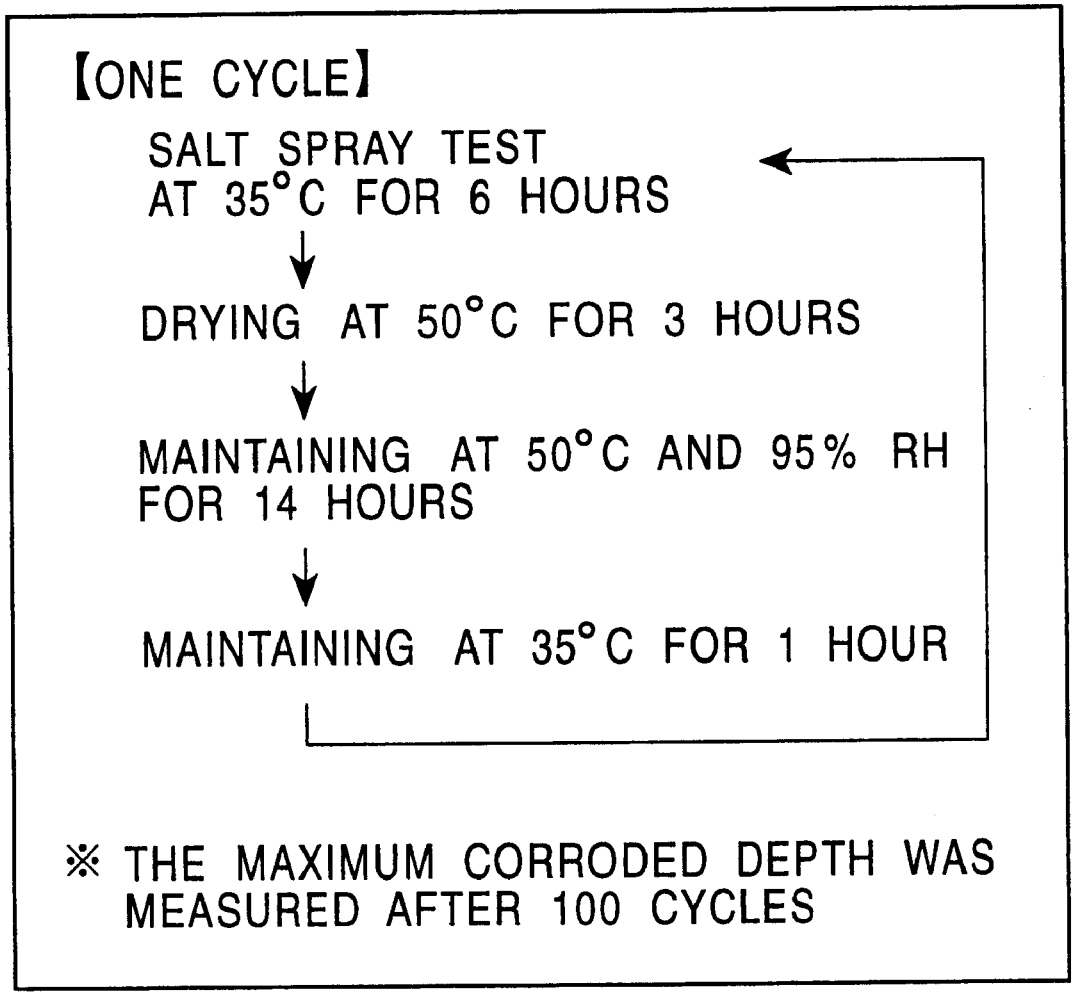
FIG. 5 is a flow chart of a combined cycling corrosion test.

The galvanized steel sheets after the zinc phosphate treatment were subjected to a chemical conversion treatment using SD2500 made by Nippon Paint Co., Ltd., and then cationic electrocoating using V20 made by Nippon Paint Co., Ltd., (thickness of the electrocoating layer: 10 μm), according to a production process for automobile bodies. A cross cut was formed on each electrocoated sample using a knife, and the sample was subjected to a combined cycling corrosion test as shown in FIG. 5. The perforative corrosion resistance of the sample was determined by the maximum corroded depth (decreased sheet thickness). The results are shown in Table 3. A smaller corroded depth in Table 3 indicates superior perforative corrosion resistance, and a corroded depth of about 0.3 mm or less is a preferred level in the present invention.

Each treated steel sheet was punched into a blank having a diameter of 100 mm, and the blank was subjected to cylindrical press working under conditions of a punch diameter of 50 mm, a die diameter of 52 mm, a blank holder pressure of 1 ton, and a punch speed of 120 mm/min. The punch load was measured to determine workability. A smaller punch load indicates improved workability. A punch load of about 3.4 or less is a preferred level in the present invention. Damage to the surface (cylindrical side face) after the press working was visually inspected. The results are shown in Table 3 in which "A" indicates slight damage at an acceptable level and "B" indicates noticeable damage at an unacceptable level.

TABLE 1

| Galvanized Steel Sheets | | |
|---|---|---|
| Type of Galvanized Steel Sheet | Coating Weight of Zinc ($g/m^2$) | Plating Process |
| EGA | 23 | Electroplating |
| EGB | 30 | Electroplating |
| GIA | 45 | Hot Dipping |
| GIB | 55 | Hot Dipping |

TABLE 2

| Composition and Temperature of Zinc Phosphate Conversion Solution | |
|---|---|
| $PO_4^{3-}$ | 5 to 30 g/L |
| $Zn^{2+}$ | 0.5 to 3.0 g/L |
| $Ni^{2+}$ | 0.1 to 10.0 g/L |
| $Mn^{2+}$ | 0.3 to 10.0 g/L |
| $Mg^{2+}$ | 3 to 50 g/L |
| $NO_3^-$ | 1 to 0.8 g/L |
| Total Fluorine | 0.1 to 0.8 g/L |
| Treating Temperature | 40° C. to 60° C. |

TABLE 3

| | Type of | Zinc Phosphate Coating Layer | | | | | | | | Evaluation | | |
|---|---|---|---|---|---|---|---|---|---|---|---|---|
| | Galvanized steel sheet | Coating Weight ($g/m^2$) | Ni (weight %) | (Ni × 7.6) −10.9 | Mn (weight %) | Ni × 11.4 | Mg (weight %) | Zinc Phosphate Crystal Shape | Zinc Phosphate Crystal Size (μm) | Perforative corrosion Resistance Corroded Depth (mm) | Press Workability Damage | Press Workability Load (t) |
| Example 1 | EGA | 1.5 | 0.8 | −4.82 | 3.2 | 9.12 | 3.5 | Granular | 1.3 | 0.12 | A | 3.21 |
| Example 2 | EGB | 2.0 | 1.2 | −1.78 | 3.6 | 13.68 | 3.8 | Granular | 1.3 | 0.18 | A | 3.20 |
| Example 3 | GIA | 1.8 | 1.9 | 3.54 | 7.9 | 21.66 | 0.6 | Foliate | 2.8 | 0.24 | A | 3.58 |
| Example 4 | GIB | 2.2 | 0.12 | −9.99 | 1.2 | 1.37 | 2.7 | Granular | 2.2 | 0.21 | A | 3.23 |
| Example 5 | EGB | 2.9 | 0.7 | −5.58 | 3.1 | 7.98 | 9.5 | Granular | 1.1 | 0.09 | A | 3.31 |
| Example 6 | GIA | 0.6 | 1.0 | −3.30 | 4.5 | 11.40 | 4.6 | Granular | 1.2 | 0.15 | A | 3.19 |
| Example 7 | EGA | 0.7 | 0.12 | −9.99 | 0.6 | 1.37 | 0.6 | Foliate | 2.9 | 0.27 | A | 3.57 |
| Example 8 | GIA | 2.8 | 1.8 | 2.78 | 5.0 | 20.52 | 5.5 | Granular | 1.2 | 0.11 | A | 3.20 |
| Comparative Example 1 | EGA | 1.8 | 1.7 | 2.02 | 1.9 | 19.38 | 0 | Foliate | 3.8 | 0.62 | A | 3.79 |
| Comparative Example 2 | EGB | 2.2 | 1.6 | 1.26 | 0.4 | 18.24 | 4.5 | Granular | 1.4 | 0.47 | A | 3.18 |
| Comparative Example 3 | GIA | 0.4 | 0.08 | −10.29 | 1.3 | 0.91 | 0.4 | Foliate | 3.3 | 0.58 | A | 3.61 |
| Comparative Example 4 | GIB | 3.1 | 2.2 | 5.82 | 0 | 25.08 | 1.9 | Foliate | 2.6 | 0.49 | B | 3.45 |
| Comparative Example 5 | EGB | 1.3 | 0 | −10.90 | 8.2 | 0 | 0.2 | Foliate | 3.7 | 0.58 | A | 3.74 |

As shown in Table 3, the steel sheets of Examples 1 to 8 exhibit superior perforative corrosion resistance. Moreover, the steel sheets of Examples 1, 2, 4 to 6, and 8 exhibit superior press workability. In Comparative Examples 1 to 5 in which at least one of the magnesium, nickel, and manganese contents lies outside the above ranges, perforative corrosion resistance is at an unacceptable level.

Accordingly, the present invention provides a galvanized steel sheet which is suitably used in automobile bodies and which has significantly improve perforative corrosion resistance after electrocoating and cost advantage.

By controlling the ranges for the magnesium, nickel, and manganese contents in the zinc phosphate coated layer to further specific ranges, a galvanized steel sheet having superior press workability in addition to perforative corrosion resistance is provided.

While the present invention has been described above in connection with several preferred embodiments, it is to be expressed understood that those embodiments are solely for illustrating the invention, and are not to be construed in a limiting sense. After reading this disclosure, those skilled in this art will readily envision insubstantial modification and substitutions of equivalent material and techniques, and all such modifications and substitutions are considered to fall within the true scope of the appended claims.

What is claimed is:

1. A galvanized steel sheet comprising:

a galvanized coating layer having a coating weight of from about 20 to about 60 $g/m^2$ formed on at least one surface of the steel sheet; and a zinc phosphate coating layer having a coating weight of from about 0.5 to about 3.0 $g/m^2$ formed on the galvanized coating layer, the zinc phosphate coating layer containing from about 0.5 to about 10.0 percent by weight of magnesium, from about 0.1 to about 2.0 percent by weight of nickel, and from about 0.5 to about 8.0 percent by weight of manganese, the manganese content and the nickel content satisfying the following relationship:

$$[Ni]\times 7.6-10.9 \leqq [Mn] \leqq [Ni]\times 11.4$$

wherein [Mn] represents the manganese content, in percent by weight, and [Ni] represents the nickel content, in percent by weight.

2. The galvanized steel sheet according to claim 1, wherein the zinc phosphate coating layer contains from about 2.0 to about 7.0 percent by weight of magnesium, from about 0.1 to about 1.4 percent by weight of nickel, and from about 0.5 to about 5.0 percent by weight of manganese.

3. The galvanized steel sheet according to claim 2, wherein zinc phosphate in the zinc phosphate coating layer comprises granular crystals having a long axis of less than about 2.5 $\mu$m.

* * * * *